US007487629B2

(12) United States Patent
Peacock

(10) Patent No.: US 7,487,629 B2
(45) Date of Patent: Feb. 10, 2009

(54) DEVICES AND METHODS FOR TWISTING YARN

(75) Inventor: Bobbie Don Peacock, Peachtree City, GA (US)

(73) Assignee: M.A. Industries, Inc., Peachtree City, GA (US)

( * ) Notice: Subject to any disclaimer, the term of this patent is extended or adjusted under 35 U.S.C. 154(b) by 102 days.

(21) Appl. No.: 11/586,871

(22) Filed: Oct. 26, 2006

(65) Prior Publication Data

US 2007/0089393 A1 Apr. 26, 2007

Related U.S. Application Data

(60) Provisional application No. 60/730,946, filed on Oct. 26, 2005.

(51) Int. Cl.
*D02G 3/06* (2006.01)

(52) U.S. Cl. ..... 57/31

(58) Field of Classification Search ..... 57/31, 57/260

See application file for complete search history.

(56) References Cited

U.S. PATENT DOCUMENTS

| | | | | |
|---|---|---|---|---|
| 99,654 A | * | 2/1870 | DeGuinon | 57/31 |
| 974,132 A | * | 11/1910 | Funke | 57/31 |
| 1,134,379 A | * | 4/1915 | Gunther | 57/31 |
| 1,671,425 A | * | 5/1928 | Heany | 57/31 |
| 2,407,926 A | | 9/1946 | Hamilton | |
| 3,145,524 A | | 8/1964 | Dewelle | |
| 3,302,380 A | | 2/1967 | Ver Meulen | |

FOREIGN PATENT DOCUMENTS

| | | |
|---|---|---|
| DE | 293 605 C | 8/1916 |
| DE | 300 167 C | 10/1919 |
| DE | 316 068 C | 11/1919 |
| GB | 04675 A | 10/1910 |
| WO | WO 2007/024059 | 3/2007 |

OTHER PUBLICATIONS

International Search Report and Written Opinion for PCT/US2006/041664 entitled Devices and Methods for Twisting Yarn, issued Feb. 13, 2007.

* cited by examiner

*Primary Examiner*—Shaun R Hurley
(74) *Attorney, Agent, or Firm*—Kilpatrick Stockton LLP; Michael A. Bertelson

(57) ABSTRACT

Devices and methods for twisting yarn may twist a strip of material, such as a paper strip, into a yarn, such as a paper yarn. Such devices and methods may involve positioning a pad formed from a roll of the material horizontally in a yarn twisting device, such that the strip of material is unwound and drawn from an outer circumference of the pad, but down through the center of the pad, and subsequently through a rotating yarn twister.

20 Claims, 5 Drawing Sheets

DEVICES AND METHODS FOR TWISTING YARN

RELATED APPLICATION

This application claims the benefit of U.S. Provisional Application Ser. No. 60/730,946, filed Oct. 26, 2005 and entitled "Device and Method for Twisting Yarn," the entire contents of which are hereby incorporated in their entirety by this reference.

RELATED FIELDS

Embodiments of the present invention relate to devices and methods for twisting yarn.

BACKGROUND

Paper tape, a relatively strong length of paper commonly used for bailing pulp, severing paper webs, and for other uses in the paper industry or other industries, may be formed by bonding a number of paper yarns together along their lengths with an adhesive. Various methods and devices have been used in the past to create the paper yarns used to form the paper tape. Many of these methods and devices involved twisting a thin paper strip about its longitudinal axis to form the yarn as the strip is pulled from a roll of paper (also referred to as a paper "pad"). The pad is formed by wrapping the strip around a tubular core.

Two types of previous yarn twisting devices are "tree twisters" and "ring twisters." The tree and ring twisters both position the pad vertically and pull the strip from the pad's outer circumference. As the device pulls the strip downward from the pad (rotating the pad about a horizontal axis), it twists the strip to form the yarn.

Tree and ring twisters may be undesirable. Ring twisters require that the pad be extensively moistened before beginning the twisting process, which adds an extra step prior to the twisting process and also may require that the yarn be dried after the twisting, before gluing it up into paper tape. Tree twisters are relatively slow—they cannot be stably run at high speeds and also have a tendency to break the paper strip at high speeds. Ring twisters can be run at higher speeds than tree twisters (but not necessarily as fast as twisters in accordance with some of the embodiments of the present invention described below), but they have other undesirable aspects. For instance, ring twisters produce a relatively unsmooth yarn and require that the yarn be collected on a vertical cylinder referred to as a "bobbin." Yarn collected on a bobbin may need to be unrolled to dry thoroughly to be used effectively in subsequent processes for forming the paper tape.

Another previous yarn twisting device is a "bowl twister." Unlike tree and ring twisters, the bowl twister positions the pad horizontally, inside a large bowl. Also unlike the tree and ring twisters, the bowl twister does not pull the strip from the outer circumference of the pad, but pulls the strip from the inner circumference of the pad. The bowl rotates as the strip is pulled down through a hole in the bottom of the bowl, facilitating twisting the strip into yarn. Bowl twisters secure the pad by snugly mounting the pad into a bore in the bowl.

Bowl twisters may also be undesirable. Fitting the pad snugly into the bore of the bowl requires that the pad be manufactured with a precise outside diameter. It is difficult, however, to manufacture a pad with a precise outer diameter, requiring that outer layers of the pad be removed (creating excessive waste) or that the pad be shimmed (a difficult and time consuming process) to make the pad fit snugly. Also undesirably—pads that are shimmed may not be able to be run stably at high speeds in a bowl twister.

SUMMARY

Some of the embodiments of the present invention provide for a yarn twisting device that may be referred to as a "fly twister," which may be run at relatively high speeds to produce a relatively smooth yarn without requiring substantial pre-wetting of the pad. The fly twister may position the pad substantially horizontally on a rotatable platform. The pad may be mounted about a hub extending from the center of the platform, such that the pad can be stably rotated at high speeds. The fly twister may unwind the strip from the outer circumference of the pad, but pass the strip through an aperture extending through the hub at the inner circumference of the pad.

DETAILED DESCRIPTION OF DRAWINGS

Figure 1:
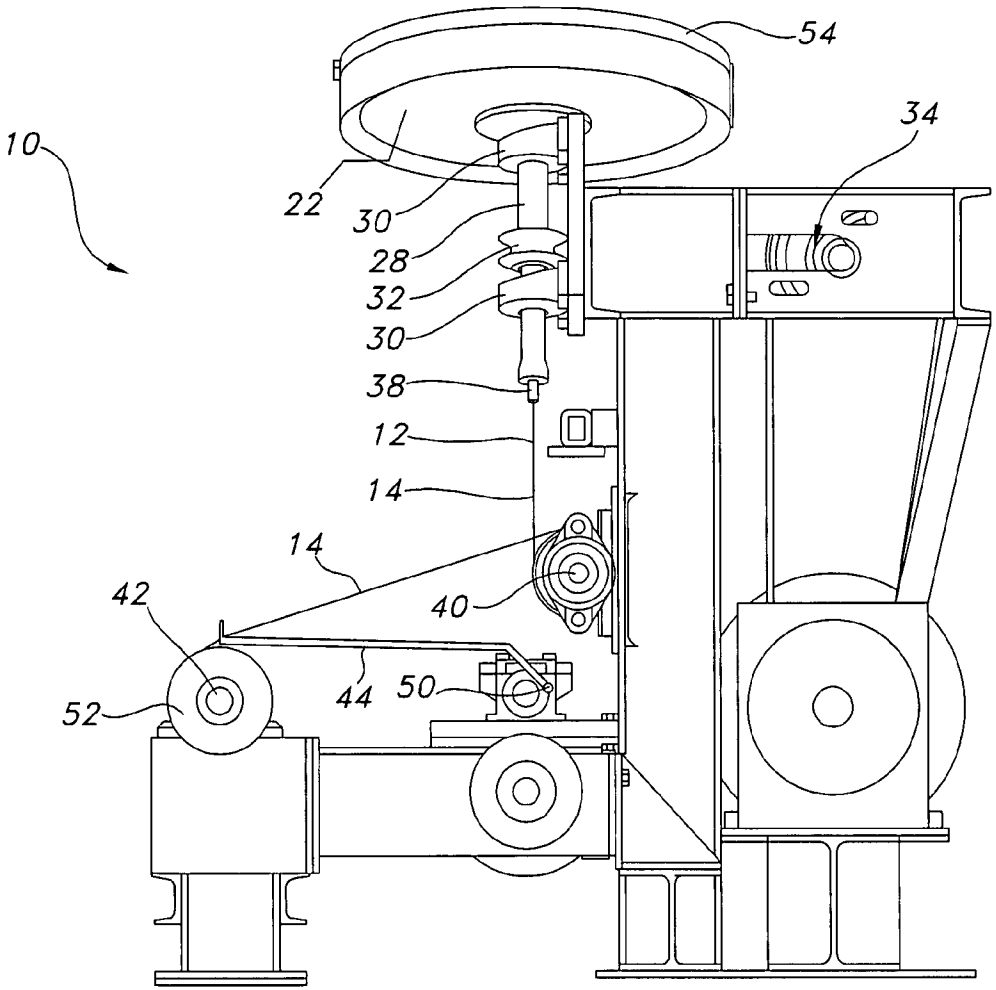
FIG. 1 schematically shows a yarn twisting device according to a first embodiment of the present invention.

FIG. 1 schematically shows a yarn twisting device 10 (which may also be referred to as a "fly twister") in accordance with some of the embodiments of the present invention. Yarn twisting device 10 may twist a strip of material 12 (shown in FIGS. 2 and 3) into a yarn 14. As shown in FIG. 3, the strip of material 12 may be a relatively thin strip of paper that is rolled up around a core 16 to form a disc shaped pad 18. In other embodiments, core 16 is not necessary and the strip of material 12 may be rolled without a core or may be formed into a pad in other manners. Additionally, yarn twisting devices in accordance with the present invention are not limited to twisting paper. Twisting devices in accordance with various embodiments of the present invention may twist other deformable materials as well, such as, but not limited to, textile materials, metal foils, deformable plastics, or other materials.

Figure 2:
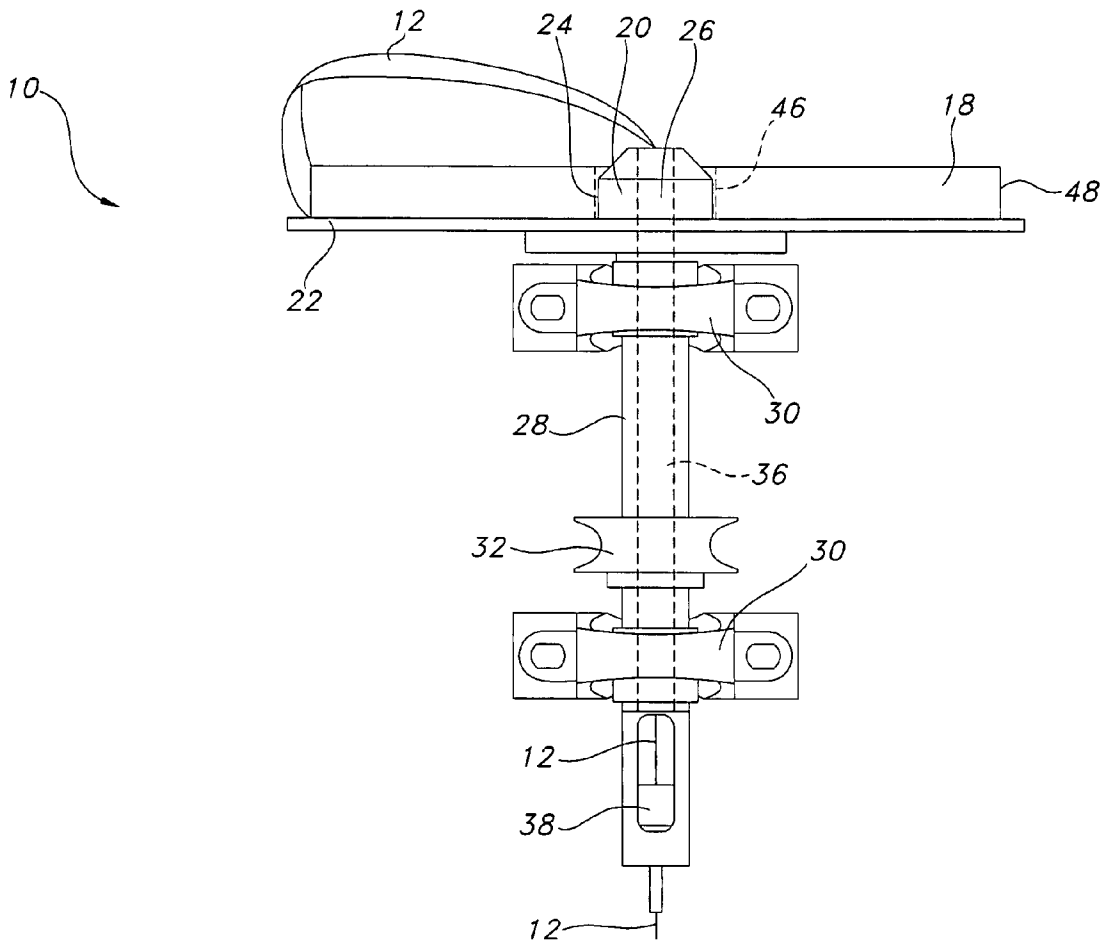
FIG. 2 schematically shows a portion of the yarn twisting device shown in FIG. 1.
Figure 3:
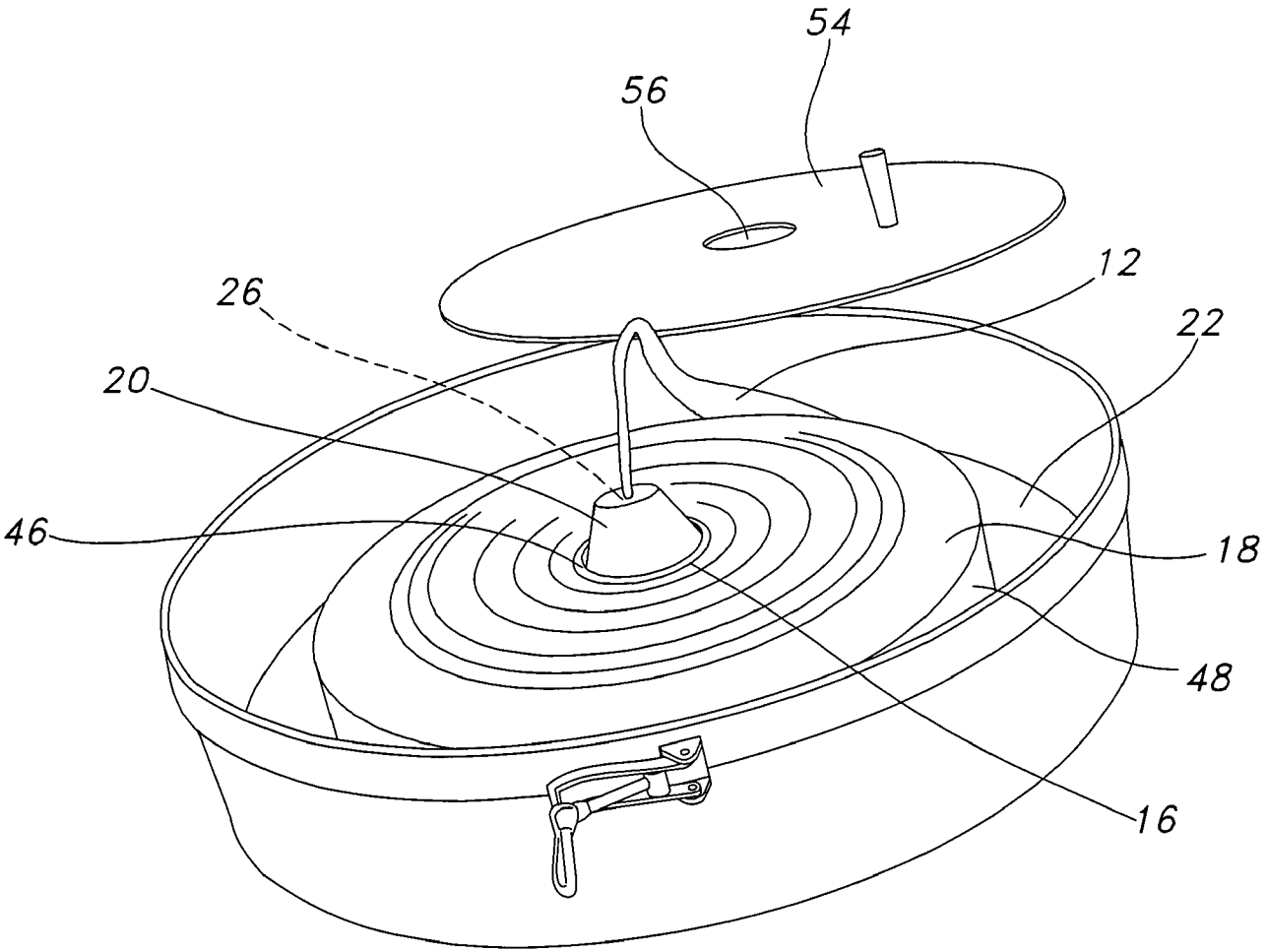
FIG. 3 schematically shows another portion of the yarn twisting device shown in FIG. 1.

As shown in FIG. 2, the pad 18 may be mounted about a hub 20 on top of a platform 22. An inner circumference of the pad 46 may fit over an outer mounting surface 24 of the hub 20. The inner circumference 46 may be the inner circumference of the pad's core 16, or in other embodiments, the core may be removed prior to mounting such that the inner circumference is defined by the end of the strip of material 12. In some embodiments, the fit between the inner circumference 46 of the pad 18 and the mounting surface 24 of the hub 20 may be relatively tight, such that as hub 20 and platform 22 rotate (as discussed further below) pad 18 will also rotate. The hub 20 may have a frustoconical shape, such as shown in FIG. 3, or may have a different shape that facilitates or allows pad 18 to be slid over hub 20. In other embodiments, it is not necessary that the fit between the inner circumference 46 and the mounting surface 24 be tight. Indeed, in some embodiments, the inner circumference 46 and the mounting surface 24 will not come in direct contact with one another and other structures or mechanisms associated with yarn twisting device 10 will facilitate rotation of the pad 18.

Figure 4:
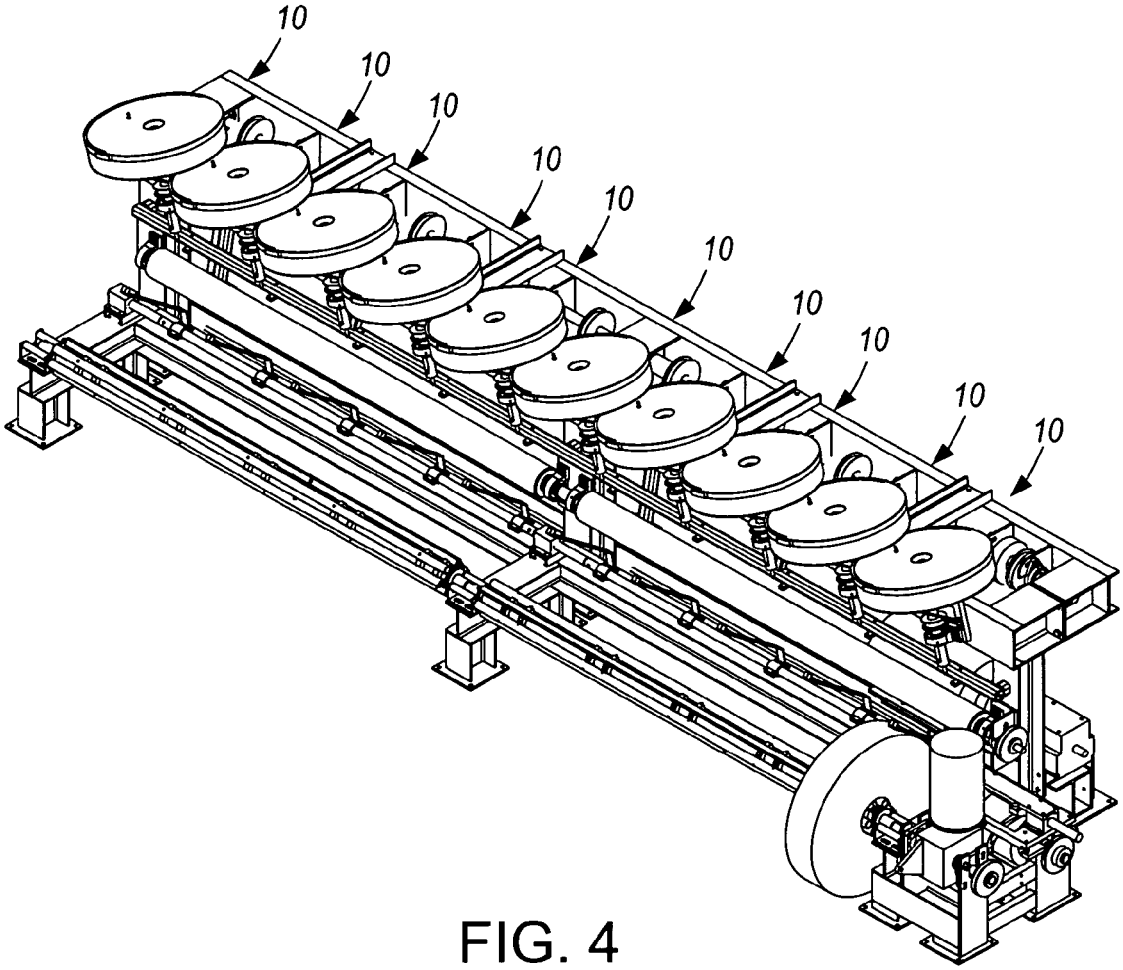
FIG. 4 shows a bank of yarn twisting devices according to another embodiment of the present invention.

In the embodiments shown in the Figures, pad 18 mounts on top of platform 22 in a substantially horizontal orientation. Although the platform 22, and consequently the pad 18, may be substantially horizontal, they may also be somewhat slanted at the same time, such as is shown in FIG. 1. In accordance with some embodiments of the present invention, it may be desirable to incorporate a number of yarn twisting devices 10 into a single bank of twisters, such as show in FIG. 4. In such embodiments, disposing the platform 22 and pad 18 in an at least somewhat slanted orientation may reduce the horizontal width of the yarn twisting devices 10, potentially increasing the number of individual devices 10 that can be included in a single bank. In still other embodiments, yarn twisting devices 10 may position pads 18 in other, non-horizontal orientations.

FIG. 2 shows the strip of material 12 unwinding from the outer circumference 48 of pad 18, extending into a longitudinal bore 26 of the hub 20. In some embodiments, the longitudinal bore 26 may have a diameter of approximately 0.125 inches and may be flared at its upper end although other dimensions and shapes are also possible. As shown in FIGS. 2 and 3, the hub 20 may extend at least somewhat above the top of pad 18. In some embodiments, the extension of the hub 20 above the pad 18, the upper end flare of the bore 26, and/or its frustoconical shape may facilitate feeding the strip of material 12 into the longitudinal bore 26 as the yarn twisting device 10 operates, as described further below. In other embodiments, however, it is not necessary that hub 20 have a frustoconical shape, a flared bore 26, or extend above the top of pad 18.

As also shown in FIG. 2, material strip 12 extends from the longitudinal bore 26 of hub 20 into a longitudinal bore 36 of drive shaft 28, which terminates at yarn twister 38. (In some embodiments, hub 20 and drive shaft 28 may be a unitary structure.) The drive shaft 28 may support the hub 20 and platform 22, such that rotating the drive shaft 28 around its longitudinal axis also rotates yarn twister 38, hub 20, platform 22, and any pad 18 mounted thereon. Support bearings 30 may secure drive shaft 28 to other components of yarn twisting device 10, such that drive shaft 28 may be rotated. Drive shaft 28 may include a drive pulley 32, which may interact with a belt (not shown) associated with a drive train 34 of the yarn twisting device 10, such that drive shaft 28 can be rotated by drive train 34. Although one type of drive system is described herein, yarn twisting devices in accordance with other embodiments of the present invention may utilize other types of traditional or non-traditional drive systems or other types of systems for rotating pad 18, yarn twister 38, and/or other components of the device 10.

The path of the strip of material 12 shown in FIG. 2 extends through yarn twister 38 at the lower end of drive shaft 28. As described further below, the yarn twister 38 may engage strip of material 12 as it passes though it such that rotating the yarn twister twists strip of material 12 into a yarn 14. In some embodiments, yarn twister 38 is a die or other structure with an internal aperture. In some embodiments, the walls of the die's internal aperture engage the strip of material to facilitate the twisting. In some embodiments the aperture may be 0.0625 inches in diameter, although it may be other sizes. In other embodiments, yarn twister 38 is not a die, and may be other structures or mechanisms that facilitate twisting a strip of material 12 into a yarn 14.

Figure 5:
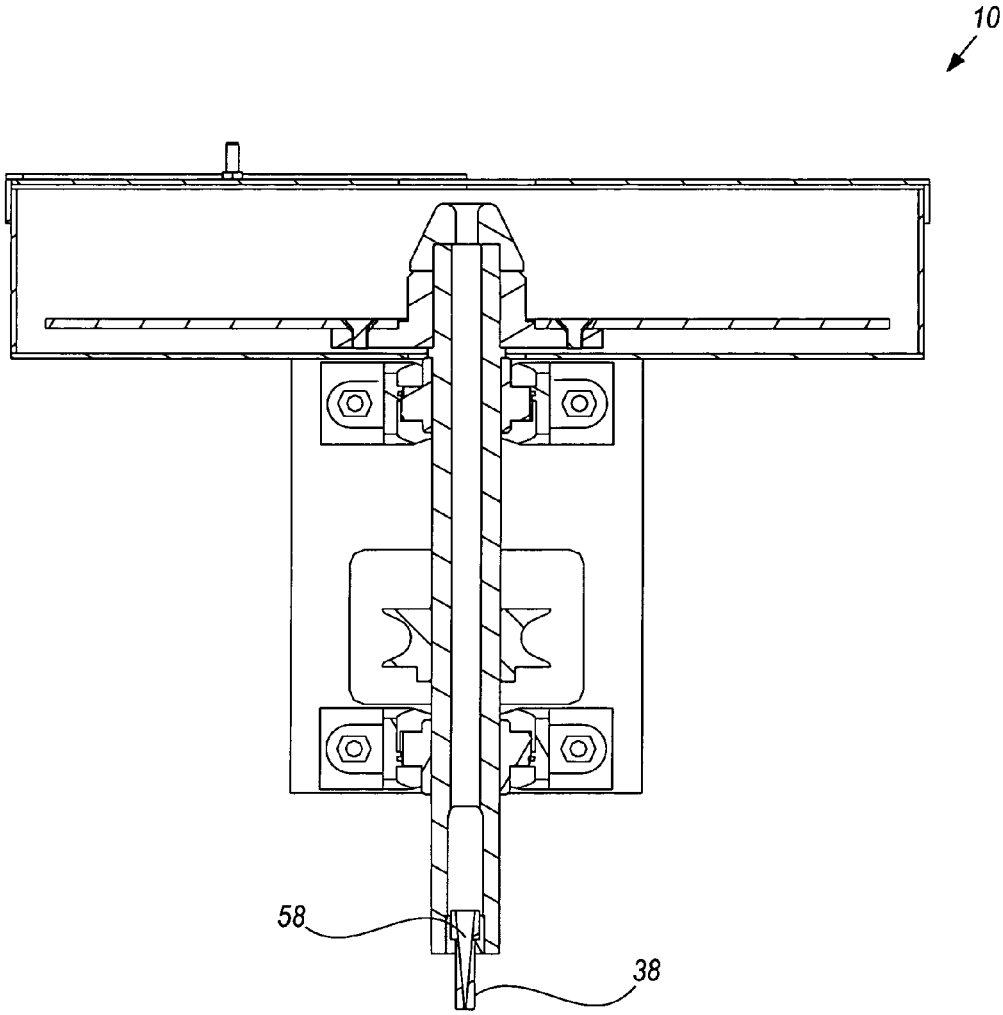
FIG. 5 schematically shows a cross section of a portion of a yarn twisting device according to some of the embodiments of the present invention.

In some embodiments, yarn twister 38 is a forming head consisting essentially of an appropriately sized circular orifice. In other embodiments, yarn twister 38 includes a conical orifice, such as the conical orifice 58 shown in FIG. 5. In accordance with various embodiments of the present invention, the twisting of strip of material 12 into yarn 14 facilitated by the yarn twister 38 may happen above/before, at, or below/after the yarn twister 38. In some embodiments, the twisting of strip of material 12 into yarn 14 occurs primarily at the yarn twister 38, but some amount of twisting may occur before and after the yarn twister 38.

In the embodiments shown in FIG. 1, the strip of material 12/yarn 14 extends from yarn twister 38 and wraps around draw roll 40. In some embodiments, the speed that the draw roll 40 rotates determines the speed at which the strip of material 12/yarn 14 is drawn through the yarn twisting device 10. In some embodiments, the surface of the draw roll 40 is smooth, but not polished, and interacts with the yarn 14 by friction. In other embodiments, however, the surface of the draw roll 40 is rough, polished, or has some other type of surface. In some embodiments, the speed of rotation of draw roll 40 is related (but not necessarily identically related or even proportionally related) to the speed of rotation of drive shaft 28, because both are rotated (at least indirectly) by drive train 34. In other embodiments, however, the speed of rotation of draw roll 40 is not tied to the speed of rotation of drive shaft 28 and these components are driven by separate mechanisms.

In the embodiments shown in FIG. 1, after yarn 14 is drawn around draw roll 40, it is collected on a reel 42. Reel 42 may be driven by drive train 34 or by some other mechanism such that it collects the yarn 14 at an appropriate rate in relation to the rotation of draw roll 40. In some embodiments, reel 42 may be driven to collect yarn at a set rate or, additionally or alternatively, may be driven to maintain a constant tension on the yarn. A guide finger assembly 44 may slide back and forth longitudinally (into and out of the plane of FIG. 1) to space the yarn 14 out longitudinally on the reel as it is collected. The guide finger 44 may include a slot (not shown) at its tip through which the yarn 14 passes for guiding where along the reel 42 the yarn 14 is wrapped. The guide finger 44 may also be pivotally mounted at pivot point 50 such that the guide finger 44 may pivot upwardly as the diameter of the package of yarn 14 increases.

In the embodiments shown in FIG. 1, yarn 14 is collected by reel 42 as a coreless package 52. In other words, in the embodiments shown in FIG. 1, once the yarn 14 wrapped around the reel 42 reaches a certain diameter, the reel 42 can be removed and the coreless package 52 can be slid off the end of the reel 42 (such that the coreless package 52 would have no "core," such as the core 16 of pad 18 discussed above).

In accordance with some embodiments of the present invention and as illustrated in FIGS. 1-3, in use, strip of material 12 may be unwound from pad 18 and drawn down through yarn twister 38 by draw roll 40 as the pad 18, hub 20, platform 22 and yarn twister 38 are all rotated by drive shaft 28. The interaction of the internal aperture of yarn twister 38 (and in some embodiments, to some extent the longitudinal bore 26 of hub 20) as they rotate in relation to the strip of material 12 as it is drawn by draw roll 40 may twist the strip into a yarn 14. In some embodiments, the yarn twisting device 10 will twist the strip of material 12 approximately two times for each inch of length. In embodiments where the aperture of yarn twister 38 is relatively small, the yarn twister 38 may also facilitate forming a relatively smooth yarn 14 as the strip of material 12 is drawn through the yarn twister 38. For instance, the internal aperture of yarn twister 38 may smooth out any splices in the strip of material 12 (such as where the strip of material 12 at the end of one pad 18 is spliced or tied to the strip of material 12 extending from the start of a new pad 18).

In accordance with some embodiments of the present invention, it may be necessary or desirable to wet the pad 18 with water or another type of liquid prior to running it through yarn twisting device 10. For instance, pre-wetting the pad 18 may reduce the chances that strip of material 12 will break or snag during the twisting process. Pre-wetting may also make the paper less brittle and allow the strip 12 to be more easily deformed into a yarn.

In some embodiments, it may be desirable to reduce the tendency of the pad 18 to dry out during twisting by disposing a cover over the pad 18. In the embodiments shown in FIGS. 1 and 3, yarn twisting device 10 includes a cover 54 that may be pivoted away to allow access to the pad 18. The cover 54 may be pivoted to extend substantially over the area above the pad's 18 upper surface. When closed, the cover 54, in conjunction with platform 22, may substantially surround the pad 18. In some embodiments, such a cover 54 may reduce the tendency of pad 18 to dry out during twisting, as described above.

In these or other embodiments, cover 54 may also reduce the air turbulence inside the covered area and consequently reduce the power necessary to rotate pad 18. For instance, as schematically represented in FIG. 2, strip of material 12 may have the tendency to "balloon up" as it is unwound from pad 18 and drawn into the longitudinal bore 26 of hub 20. That portion of the strip of material 12 may cause friction with the surrounding air as it unwinds from the outer circumference of the pad 18 and moves into the longitudinal bore 26 of hub 20. In some embodiments, the cover 54 may reduce the stress on strip of material 12 as it unwinds.

As shown in FIG. 3, the cover 54 may include an aperture 56. Aperture 56 may facilitate dissipation of heat from inside cover 54, by allowing a controlled quantity of air to circulate into the covered area. Aperture 56 may also allow an operator to view the status of the pad 18, and the amount of material that has been unwound from it.

Additions, deletions, modifications, or other changes to the above described embodiments may be made without departing from the scope or spirit of the present invention.

The invention claimed is:

1. A yarn twisting device, comprising:

(a) a strip of material, wherein a wound portion of the strip comprises a pad, and wherein a length of the strip extends from an outer circumference of the pad;

(b) a platform supporting the pad;

(c) a hub comprising an outer mounting surface surrounding a longitudinal bore, wherein an inner circumference of the pad is mounted about the hub mounting surface, and wherein the length of strip extending from the outer circumference of the pad extends above the pad and down through the longitudinal bore of the hub; and (d) a yarn twister, wherein the length of strip extending from the outer circumference of the pad and through the longitudinal bore of the hub passes through an aperture of the yarn twister;

wherein the yarn twisting device twists the strip into a yarn.

2. The yarn twisting device of claim 1, wherein the strip of material comprises a strip of paper.

3. The yarn twisting device of claim 1, wherein the platform and the pad are substantially horizontal.

4. The yarn twisting device of claim 3, wherein the platform and the pad are at least somewhat slanted.

5. The yarn twisting device of claim 3, further comprising a cover extending substantially over an area above an upper surface of the pad.

6. The yarn twisting device of claim 5, wherein the cover and the platform together substantially surround the pad.

7. The yarn twisting device of claim 6, wherein the cover further comprises an aperture.

8. The yarn twisting device of claim 1, further comprising a reel for collecting the yarn.

9. The yarn twisting device of claim 8, wherein the reel collects the yarn as a coreless package.

10. The yarn twisting device of claim 1, wherein at least a portion of the hub outer mounting surface comprises a frustoconical shape.

11. The yarn twisting device of claim 1, wherein the yarn twister comprises a die.

12. A yarn twisting device, comprising:

(a) a strip of paper, wherein a wound portion of the strip comprises a pad and wherein a length of the strip extends from an outer circumference of the pad;

(b) a platform supporting the pad, wherein the platform and the pad are substantially horizontal, and wherein the platform and the pad are substantially surrounded by a cover, the cover comprising an aperture;

(c) a hub comprising an outer mounting surface surrounding a longitudinal bore, wherein an inner circumference of the pad is mounted about the hub mounting surface, and wherein the length of strip extending from the outer circumference of the pad extends above the pad and down through the longitudinal bore of the hub; and (d) a yarn twister, wherein the length of strip extending from the outer circumference of the pad and through the longitudinal bore of the hub passes through an aperture of the yarn twister;

wherein the yarn twisting device twists the strip into a yarn as the strip passes through the yarn twister as the yarn twister rotates.

13. A method for twisting yarn, comprising:

(a) obtaining a strip of paper, wherein a wound portion of the strip comprises a pad, and wherein a length of the strip extends from an outer circumference of the pad;

(b) mounting the pad about a hub;

(c) extending the length of strip extending from the outer circumference of the pad above the pad and down through a longitudinal bore of the hub;

(d) passing the length of strip extending from the outer circumference of the pad and extending above the pad and down through the longitudinal bore of the hub through a yarn twister; and (e) twisting the strip into a paper yarn.

14. The method for twisting yarn of claim 13, further comprising substantially covering an area above an upper surface of the pad with a cover.

15. The method for twisting yarn of claim 14, wherein substantially covering an area above an upper surface of the pad comprises substantially surrounding the pad.

16. The method for twisting yarn of claim 13, further comprising collecting the yarn as a coreless package.

17. The method for twisting yarn of claim 16, wherein collecting the yarn comprises collecting the yarn on a reel.

18. The method for twisting yarn of claim 13, wherein mounting the pad on the hub comprises mounting the pad in a substantially horizontal orientation on a platform.

19. The method for twisting yarn of claim 18, wherein mounting the pad in a substantially horizontal orientation comprises mounting the pad in an at least somewhat slanted orientation.

20. The method for twisting yarn of claim 13, further comprising wetting the pad prior to mounting the pad on the hub.

* * * * *